US009420376B2

(12) United States Patent
Furuya et al.

(10) Patent No.: US 9,420,376 B2
(45) Date of Patent: Aug. 16, 2016

(54) MICROPHONE

(71) Applicant: KABUSHIKI KAISHA AUDIO-TECHNICA, Machida-shi, Tokyo (JP)

(72) Inventors: Hiroaki Furuya, Machida (JP); Hiroshi Akino, Machida (JP)

(73) Assignee: KABUSHIKI KAISHA AUDIO-TECHNICA, Machida-Shi, Tokyo (JP)

( * ) Notice: Subject to any disclaimer, the term of this patent is extended or adjusted under 35 U.S.C. 154(b) by 80 days.

(21) Appl. No.: 14/146,322

(22) Filed: Jan. 2, 2014

(65) Prior Publication Data

US 2014/0198942 A1 Jul. 17, 2014

(30) Foreign Application Priority Data

Jan. 16, 2013 (JP) ..... 2013-005650

(51) Int. Cl.

| | |
|---|---|
| ***H04R 9/02*** | (2006.01) |
| ***H04R 1/04*** | (2006.01) |
| ***H04R 3/00*** | (2006.01) |
| *H04R 9/08* | (2006.01) |
| *H04R 1/08* | (2006.01) |
| *H04R 1/28* | (2006.01) |

(52) U.S. Cl.

CPC ..... *H04R 9/025* (2013.01); *H04R 1/04* (2013.01); *H04R 3/00* (2013.01); *H04R 1/08* (2013.01); *H04R 1/2807* (2013.01); *H04R 1/2892* (2013.01); *H04R 9/08* (2013.01)

(58) Field of Classification Search

CPC ..... H04R 1/00; H04R 1/02; H04R 1/04; H04R 1/08; H04R 1/14; H04R 1/32; H04R 1/34; H04R 1/38; H04R 9/00; H04R 9/025; H04R 9/08; H04R 11/04; H04R 17/02; H04R 19/016; H04R 19/04; H04R 21/00; H04R 21/02; H04R 21/025; H04R 25/43; H04R 25/554

USPC ..... 381/26, 91, 95, 111–115, 122, 381/150–151, 355–369, 175, 375, 71.6

See application file for complete search history.

(56) References Cited

U.S. PATENT DOCUMENTS

| | | | | |
|---|---|---|---|---|
| 6,060,969 | A * | 5/2000 | Hufgard | H03K 17/97 324/207.21 |
| 2003/0156727 | A1* | 8/2003 | Vonlanthen | 381/330 |
| 2005/0239305 | A1* | 10/2005 | Akino | H01R 13/652 439/106 |
| 2006/0018494 | A1* | 1/2006 | Van Halteren | 381/171 |
| 2009/0262968 | A1* | 10/2009 | Akino | H01R 9/032 381/369 |
| 2012/0002832 | A1* | 1/2012 | Okita | H04R 9/08 381/361 |

FOREIGN PATENT DOCUMENTS

| | | | |
|---|---|---|---|
| JP | H06-225376 | A | 8/1994 |
| JP | 2009-218685 | A | 9/2009 |

* cited by examiner

*Primary Examiner* — Md S Elahee

(74) *Attorney, Agent, or Firm* — Manabu Kanesaka

(57) ABSTRACT

A back air room of a microphone unit can be enlarged and a model with a sound signal output switch can easily be diverted to a switchless model. A reed switch 16 is used as the sound signal output switch which turns on or off the sound signal from a microphone unit 1. This reed switch is disposed at an output connector 11 portion at an rear end of a microphone case 6. It is arranged that a magnet 22 is disposed at a connector cover 21 which surrounds an output connector and relative movement of the connector cover with respect to the output connector allows on/off operation. Thus, by removing the connector cover 21, it is possible to provide the microphone as a switchless model which always outputs the sound signal from the microphone unit 1.

11 Claims, 6 Drawing Sheets

MICROPHONE

RELATED APPLICATIONS

The present application is based on, and claims priority from, Japanese Application No. JP2013-005650 filed Jan. 16, 2013, the disclosure of which is hereby incorporated by reference herein in its entirety.

BACKGROUND OF THE INVENTION

1. Field of the Invention

The present invention particularly relates to a dynamic microphone in which a model provided with an output switch for a sound signal from a microphone unit can be easily diverted to a switchless model.

2. Background of the Related Art

A dynamic microphone is also called an "electrodynamic microphone", since a voice coil attached to a diaphragm is disposed in a magnetic gap formed in a magnetic circuit, and a sound signal current is generated in the voice coil by vibration of a diaphragm.

In order to obtain a good frequency characteristic in a low bandwidth, this dynamic microphone is arranged such that an air room is provided at the back of a microphone unit and the back of the diaphragm is communicated with the above-mentioned air room so as to obtain a non-directional component.

Since it is desirable that the volume of the air room formed at the rear of the above-mentioned microphone unit is large, the whole inside of a microphone case may be used as an air room.

FIG. 8A shows an example in section. A microphone unit 1 provided with a voice coil and a diaphragm to which a magnetic circuit is attached is fitted in a microphone case 6 through a holder 4 and a shock mount member 5 formed of an elastic material (for example rubber) in the shape of a cylinder.

Further, the back of the diaphragm in the microphone unit 1 is communicated with the above-mentioned microphone case 6, and it is arranged that the whole interior space of the microphone case 6 is used as a back air room 6*a*.

It should be noted that reference numeral 8 indicates a seal member arranged in the vicinity of the output connector at the rear end of the microphone case 6.

Further, the above-mentioned microphone may be of a model provided with a switch for turning on or off (ON/OFF control) the sound signal output from the microphone unit.

FIG. 8B shows an example thereof in section, in which an opening 6*b* is formed at a side wall of the microphone case 6 and a microphone switch 9 is attached to this opening 6*b*.

In this case, since an air leak may occur between the above-mentioned opening 6*b* provided for the microphone case 6 and the microphone switch 9, the microphone unit 1 is mounted in the microphone case 6 through the cup-shaped shock mount member 5 whose bottom is sealed.

Therefore, in the example shown in FIG. 8B, since the inside of the cup-shaped shock mount member 5 is a sealed back air room 5*a* and the above-mentioned microphone switch 9 is provided, there are restrictions on the volume of air room 5*a* formed in the shock mount member 5.

Then, it is possible to employ a structure shown in FIG. 8C in which the microphone switch 9 is mounted at the side wall of the microphone case 6, while employing the structure in which the microphone unit 1 is mounted in the microphone case 6 using the shock mount member 5 formed in the shape of a cylinder as shown in FIG. 8A.

According to the structure shown in FIG. 8C above, although the whole inside of the microphone case 6 can be used as the back air room 6*a* of the microphone unit 1, some treatments are needed, such as filling a gap with for example silicon resin etc., or sealing the gap by a component like rubber packing member, in order to prevent the air leak between the opening 6*b* formed at the side wall of the microphone case 6 and the microphone switches 9.

As described above, in the model provided with the output switch 9 of the sound signal from the above-mentioned microphone unit 1, it is necessary to consider the arranged position of the above-mentioned switch 9 in order to enlarge the back air room of the microphone unit 1. As disclosed by for example, Japanese Patent Application Publication No. H6-225376 and Japanese Patent Application Publication No. 2009-218685, it is possible to arrange the above-mentioned switch at the output connector portion at the rear end of the microphone case 6.

Incidentally, depending on the scene where the microphone is used, different decision is made as to whether the output switch for the sound signal is required for the microphone side.

For example, when using a microphone on a stage etc., a skilled adjustment personnel performs input operation of the microphone by means of a control board in order to prevent using the microphone with the above-mentioned switch being turned off accidentally, and in order to avoid generation of electric crashing noises caused by switching operation etc. In this case, the switchless model is required for the microphone.

Further, when using it for a lecture meeting, a speech, etc., a model with a switch is required since a user himself or herself performs on/off control by hand as needed.

For this reason, also in the microphone of substantially the same specification and performance, both types, a model with a switch and a switchless model, must be produced commercially in some cases, and it is necessary to design, manufacture, manage, etc. each model, leading to a problem that manufacture costs etc. increase for each model.

SUMMARY OF THE INVENTION

The present invention aims to provide a microphone arranged such that a switch for sound signal output from a microphone unit is disposed at an output connector portion at the rear end of a microphone case as disclosed by Japanese Patent Application Publication No. H6-225376 and Japanese Patent Application Publication No. 2009-218685 in order to enlarge the back air room of the microphone unit, and the above-mentioned model with a switch can be diverted to a switchless model easily.

The microphone in accordance with the present invention made in order to achieve the above-mentioned object is a microphone having a microphone unit where a voice coil attached to a diaphragm is disposed in a magnetic gap of a magnetic circuit so as to vibrate, wherein a sound signal output switch for subjecting a sound signal from the above-mentioned microphone unit to on/off control is disposed at an output connector portion at the rear end of a microphone case in which the above-mentioned microphone unit is accommodated, and wherein the above-mentioned sound signal output switch turns on or off the sound signal from the above-mentioned microphone unit based on movement of a connector cover which surrounds the above-mentioned output connector.

In this case, an arrangement is suitably employed in which a switch means that is turned on or off in response to an external magnetic field is provided as the above-mentioned sound signal output switch, a magnet is disposed at the connector cover that surrounds the above-mentioned output connector, and relative movement of the above-mentioned connector cover with respect to the above-mentioned output connector causes the above-mentioned magnet to approach and move away from the above-mentioned switch means so that the above-mentioned switch means subjects the sound signal from the above-mentioned microphone unit to the on/off control.

Further, in a preferred embodiment, the above-mentioned output connector is constituted by a cylindrical connector receptacle and the above-mentioned connector cover which circumferentially covers the connector receptacle and is formed in the shape of a cylinder. As the above-mentioned connector cover relatively moves in the axial direction with respect to the above-mentioned connector receptacle, the above-mentioned magnet approaches and moves away from the above-mentioned switch means so as to subject the above-mentioned switch means to on/off control.

In another preferred embodiment, the above-mentioned output connector is constituted by the cylindrical connector receptacle and the above-mentioned connector cover which circumferentially covers the connector receptacle and is formed in the shape of a cylinder. As the above-mentioned connector cover rotates about an axis with respect to the above-mentioned connector receptacle, the above-mentioned magnet approaches and moves away from the above-mentioned switch means so as to subject the above-mentioned switch means to on/off control.

In this case, it is possible to employ an arrangement where the above-mentioned switch means which is turned on or off in response to an external magnetic field preferably comprises a reed switch or a Hall element.

In addition, each of the above-mentioned arrangements can suitably be employed for the microphone in which the back of the diaphragm that constitutes the above-mentioned microphone unit is opened in the above-mentioned microphone case. Further, each of the above-mentioned arrangements can suitably be employed for a so-called cancel-type microphone in which the back of the diaphragm that constitutes the above-mentioned microphone unit is communicated with the inside of a hollow member that forms a back air room, and the above-mentioned hollow member is accommodated in the above-mentioned microphone case so as to reduce vibration noises.

According to the thus arranged microphones, one such arrangement is employed in which the sound signal output switch for subjecting the sound signal from the microphone unit to on/off control is disposed at the output connector portion at the rear end of the microphone case where the above-mentioned microphone unit is accommodated.

Accordingly, in the dynamic microphone where the voice coil is disposed in the magnetic gap of the magnetic circuit so as to vibrate, the existence of the output switch for the sound signal can solve the problem with restrictions on the volume of the back air room of the microphone unit.

Further, the output switch for the above-mentioned sound signal is arranged to turn on or off the sound signal outputted from the microphone unit to the above-mentioned output connector based on the movement of the connector cover which surrounds the output connector.

Therefore, it is possible to design the microphone with a switch arranged such that the above-mentioned connector cover moves relatively in the axial direction of the connector receptacle so as to turn on or off the sound signal output, or arranged such that the above-mentioned connector cover rotates about the axis of the connector receptacle so as to turn on or off the sound signal output.

Further, in another preferred embodiment, the above-mentioned connector cover is arranged to be detachable from the above-mentioned microphone.

According to the thus arranged microphone, by removing the connector cover from the output connector, operation of the output switch for the sound signal can be disabled so that the microphone with a switch can be easily diverted to the switchless microphone.

DESCRIPTION OF THE PREFERRED EMBODIMENTS

Figure 1:
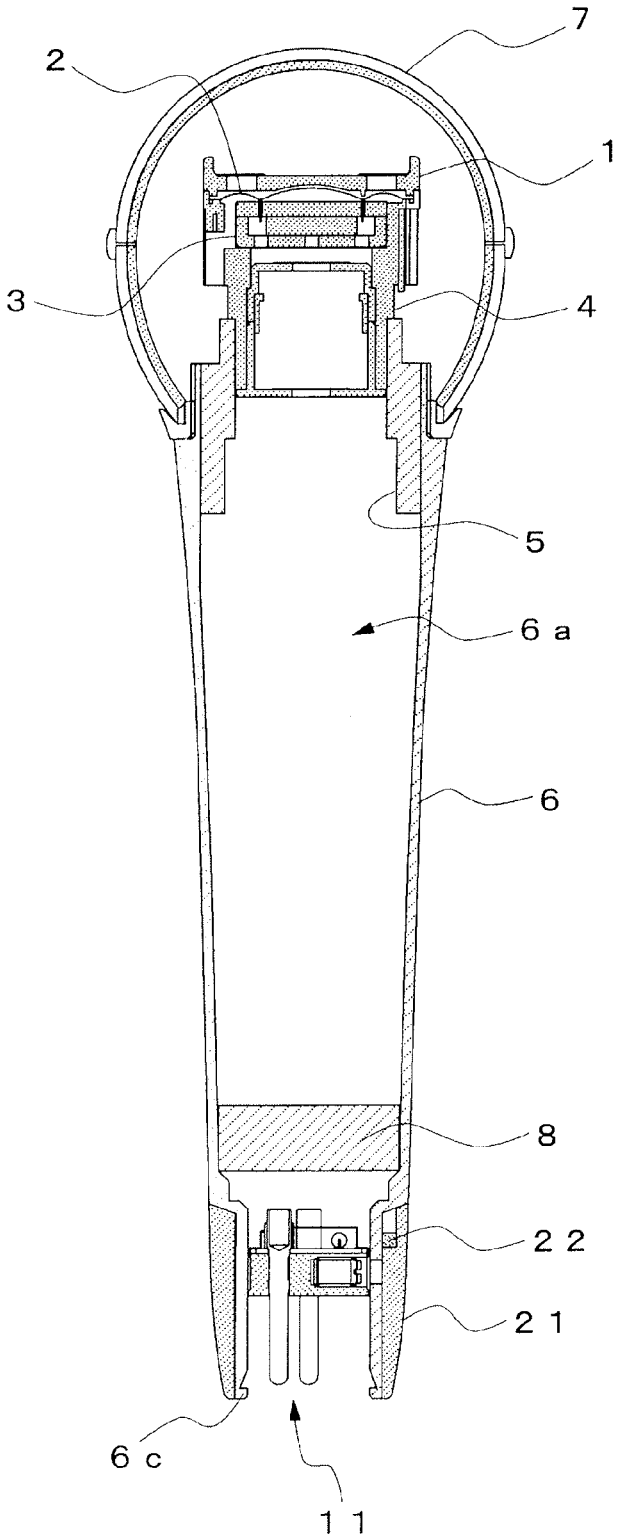
FIG. 1 is an axial sectional view showing the whole structure of a microphone of a first preferred embodiment in accordance with the present invention.

A microphone in accordance with the present invention will be described with reference to the preferred embodiments shown in the drawings. It should be noted that, in each drawing as illustrated below, like parts and those achieving the same function are referred to by like numerals, but reference numerals are assigned to typical parts in some drawings, and the detailed structures may be described with reference to numerals used in other drawings for the sake of brevity.

FIG. 1 shows the whole structure of a first preferred embodiment, and reference numeral 1 denotes a microphone unit. As is well known, this microphone unit 1 is provided with a diaphragm 2 having a voice coil and a magnetic circuit 3 having a magnetic gap where the above-mentioned voice coil is arranged to be able to vibrate. A circumference of a yoke which constitutes the above-mentioned magnetic circuit 3 of the microphone unit 1 is attached to and fitted into a holder 4 which is formed in the shape of a cylinder.

Further, the above-mentioned holder 4 is attached to a microphone case 6 through a shock mount member 5 formed of elastic materials, such as rubber, in the shape of a cylinder.

The above-mentioned microphone unit 1 is arranged to be covered with a head case 7 which is attached to the front end of the microphone case 6 and which is spherically formed of, for example, a metal mesh.

Accordingly, a dynamic microphone shown in FIG. 1 is arranged such that the back of the diaphragm 2 disposed at the microphone unit 1 is communicated with the inside of the above-mentioned microphone case 6 and the whole interior space of the microphone case 6 is used as a back air room 6*a*. It should be noted that reference numeral 8 indicates a seal member for sealing the back air room 6*a* arranged in the vicinity of the output connector at the rear end of the microphone case 6.

An outer diameter of the rear end of the above-mentioned microphone case 6 is somewhat reduced to form a cylindrical connector receptacle 6*c*, and the above-mentioned output connector 11 is disposed inside this connector receptacle 6*c*.

Figure 2:
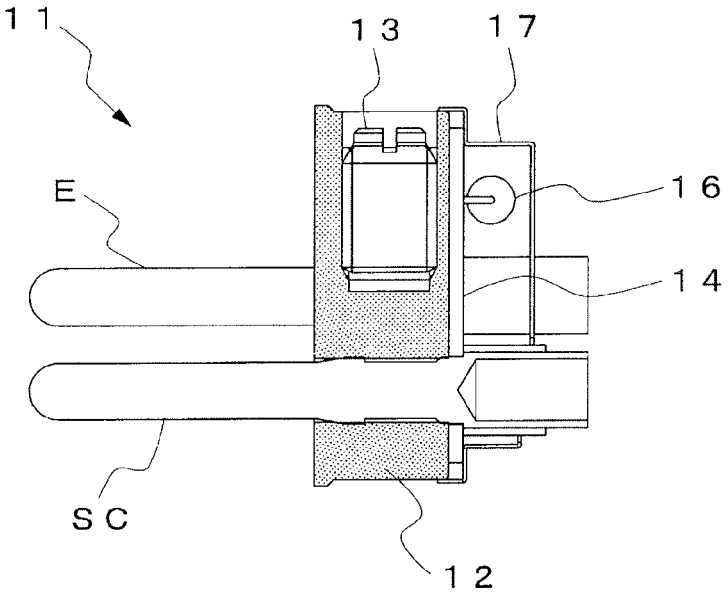
FIG. 2 is an enlarged sectional view showing a structure of an output connector used for the microphone shown in FIG. 1.
Figure 3:
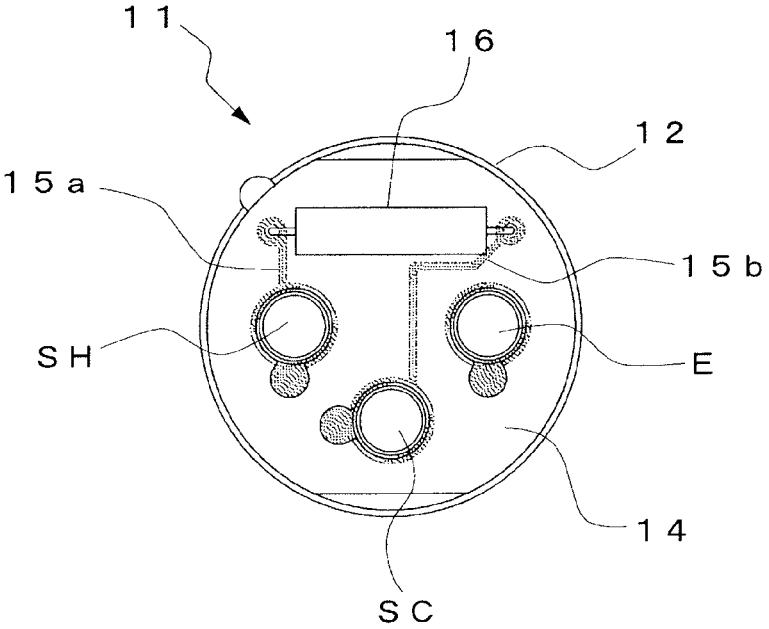
FIG. 3 is a top view of the output connector, viewed from a microphone case side.

As shown in FIGS. 2 and 3 on an enlarged scale, this output connector 11 is provided with a disc-shaped connector base 12 made of an electric insulator. Further, in this connector base 12, three connector pins, i.e., a first pin E for grounding, a second pin SH on the hot side of a signal, and a third pin SC on the cold side of the signal are press-fitted in and attached to the connector base 12, respectively.

Further, a fixing screw 13 screwed into the above-mentioned connector base 12 and attached thereto through its circumference, and this screw 13 has the function of attaching the above-mentioned connector base 12 to the connector receptacle 6*c* of the microphone case 6 and electrically connecting the above-mentioned first pin E for grounding to the above-mentioned microphone case 6.

A circuit board 14 is attached to the above-mentioned connector base 12 on the center side of the microphone case 6. This circuit board 14 has formed thereon circuit patterns 15*a* and 15*b* connected to the above-mentioned second pin SH and the third pin SC, respectively. Further, connected between these circuit patterns 15*a* and 15*b* is a reed switch 16 which is turned on or off in response to an external magnetic field and is mounted on the above-mentioned circuit board 14.

In addition, as shown in FIG. 2, a case 17 is attached to the circuit board 14 in which the above-mentioned reed switch 16 is mounted, and the reed switch 16 is covered with the above-mentioned case 17. It should be noted that FIG. 3 shows the situation where the above-mentioned case 17 is removed.

Returning to FIG. 1, the connector cover 21 formed in the shape of a cylinder is attached to and surrounds the connector receptacle 6*c* whose outer diameter is somewhat reduced at the rear end of the above-mentioned microphone case 6. This connector cover 21 is arranged such that its outer periphery is substantially flush with an outer periphery of the above-mentioned microphone case 6, and a bar-like magnet 22 is mounted inside the connector cover 21.

The connector cover 21 to which the above-mentioned magnet 22 is attached can employ first and second structures shown in FIGS. 4 and 5 in order to turn on or off the reed switch 16 provided for the above-mentioned output connector 11.

Figure 4A:
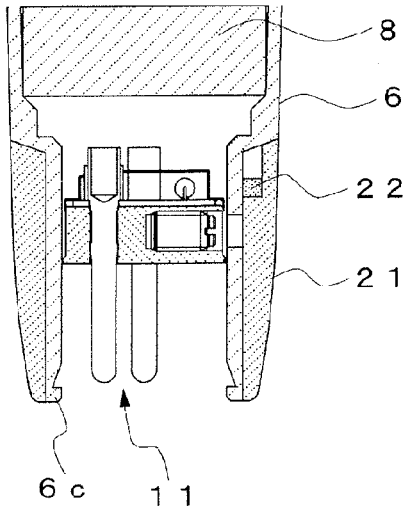
FIG. 4A is an axial sectional view showing a first structure of an output switch for a sound signal in a situation where the switch is in an ON state.
Figure 4B:
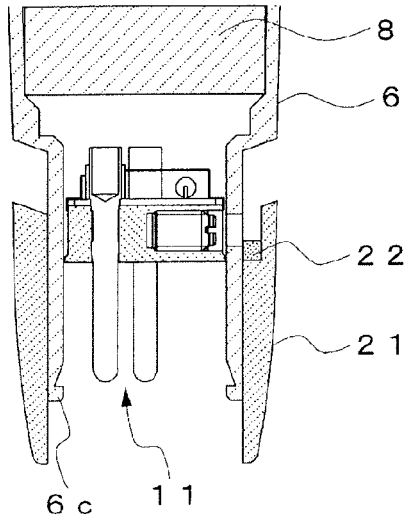
FIG. 4B is an axial sectional view showing the first structure of the output switch for the sound signal in a situation where the switch is in an OFF state.

In the first structure shown in FIGS. 4A and 4B, the above-mentioned connector cover 21 is mounted to be slidable in an axial direction of the connector receptacle 6*c*, and the above-mentioned magnet 22 fitted in the connector cover 21 as shown in FIG. 4A approaches the reed switch 16 so as to be opposed thereto.

Accordingly, facing contacts of the reed switch 16 are excited to have different polarities. As a result, the above-mentioned reed switch 16 is caused to be in an ON state.

Further, as shown in FIG. 4B, as the connector cover 21 slides in the axial direction of the connector receptacle 6*c*, the above-mentioned magnet 22 separates from (is spaced from) the reed switch 16, whereby the reed switch 16 is caused to be in an OFF state.

Since each terminal of the above-mentioned reed switch 16 is connected between the second pin SH on the hot side of the signal in the output connector 11 and the third pin SC on the cold side of the signal as already described, sound signal output from the microphone unit 1 is in a short circuit state in the situation shown in FIG. 4A, and output from the output connector 11 is blocked.

Further, the reed switch 16 is caused to be in the OFF state in the situation shown in FIG. 4B. As a result, the sound signal output from the microphone unit 1 is outputted through the output connector 11 as it is.

In addition, the above-mentioned connector cover 21 is arranged to be slid outside the connector receptacle 6*c* in the axial direction in the embodiment shown in FIGS. 4A and 4B. In this case, although not shown in the drawings, it is desirable that the connector cover 21 is positioned with click operation at the connector receptacle 6*c* in a situation shown in FIG. 4A and a situation shown in FIG. 4B, respectively.

Figure 5A:
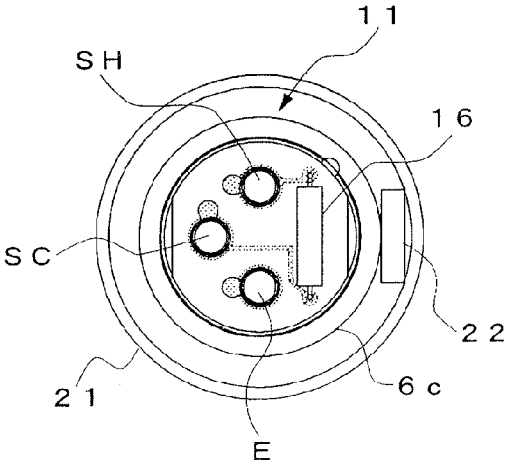
FIG. 5A is a horizontal (perpendicular to the axis) sectional view of a second structure of the sound signal output switch in a situation where the switch is in the ON state.
Figure 5B:
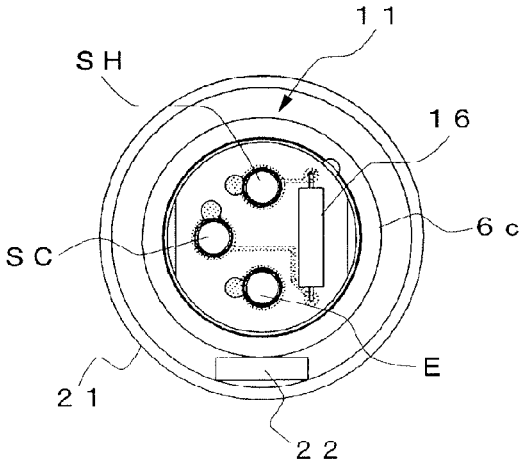
FIG. 5B is a horizontal (perpendicular to the axis) sectional view of the second structure of the sound signal output switch in a situation where the switch is in the OFF state.

Next, FIGS. 5A and 5B are sectional views, cut horizontally (perpendicularly to the axis) at a portion immediately above the output connector 11. In this example, the above-mentioned connector cover 21 is attached to the connector receptacle 6*c* to be rotatable about the axis.

That is to say, in a situation shown in FIG. 5A, the above-mentioned magnet 22 provided for the connector cover 21 approaches the reed switch 16 so as to be opposed thereto. Thus, the facing contacts of the reed switch 16 are excited to have different polarities. As a result, the above-mentioned reed switch 16 is caused to be in the ON state.

Further, as shown in FIG. 5B, the connector cover 21 is rotated by approximately 90 degrees about the axis of the connector receptacle 6*c*, so that the above-mentioned magnet 22 moves away from the reed switch 16 and a direction of magnetic flux which acts on the reed switch 16 also rotates by 90 degrees, thus the reed switch 16 is in the OFF state.

According to this operation, as described above, the sound signal output from the microphone unit 1 is in the short circuit state in the situation shown in FIG. 5A, and the output from the output connector 11 is blocked.

Further, in the situation shown in FIG. 5B, the reed switch 16 is caused to be in the OFF state. As a result, the sound signal output from the microphone unit 1 is outputted through the output connector 11 as it is.

In addition, in the structure shown in FIGS. 5A and 5B, the above-mentioned connector cover 21 is arranged to be rotated about the axis of the above-mentioned connector receptacle 6*c*. Also in this case, although not shown in the drawings, it is desirable that the connector cover 21 is positioned with click operation at the connector receptacle 6*c* in a situation shown in FIG. 5A and a situation shown in FIG. 5B, respectively.

According to the above-described structure of the microphone, as the connector cover 21 moves in the axial direction relatively to the above-mentioned connector receptacle 6*c* or rotates axially, the sound signal output from the microphone unit 1 is subjected to the on/off control.

The above-mentioned connector cover 21 is arranged to be detachable from the connector receptacle 6*c*.

Figure 6:
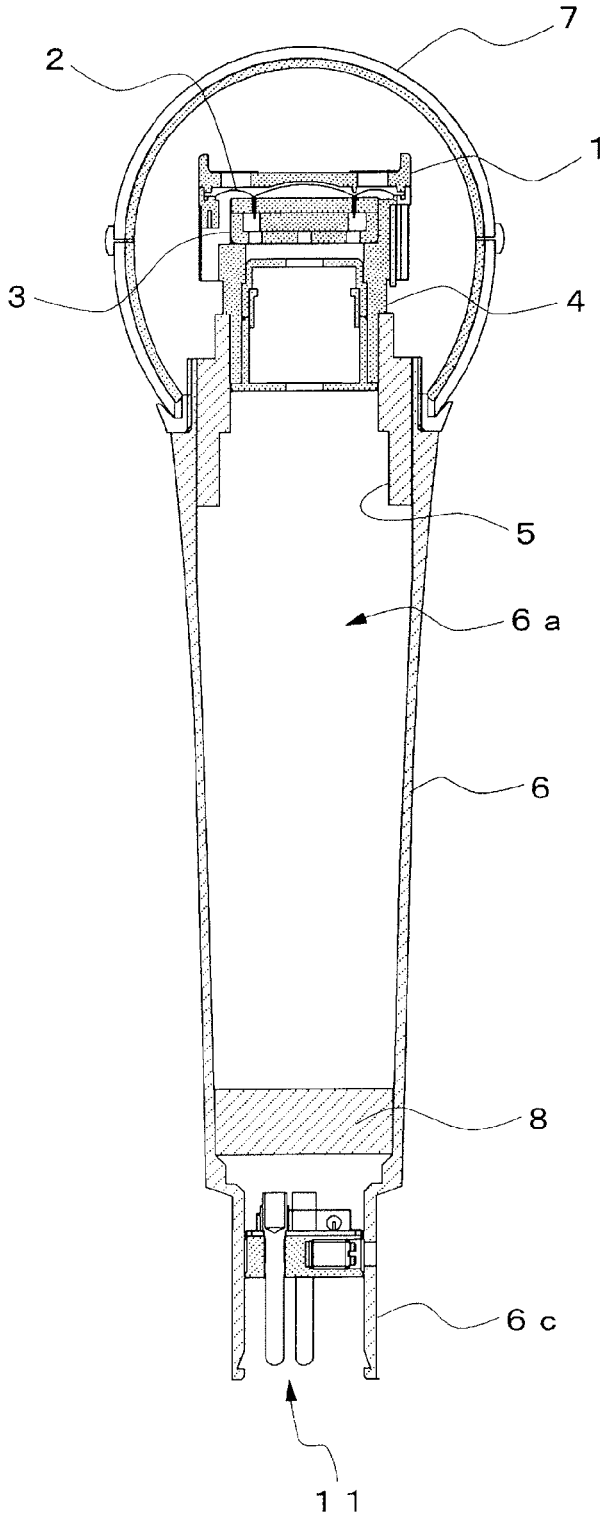
FIG. 6 is an axial sectional view showing a situation where the microphone of a first embodiment is diverted to a switchless model.

Therefore, according to the microphone of the embodiment shown in FIG. 6 where the above-mentioned connector cover 21 is not provided outside the connector receptacle 6*c*, the sound signal from the microphone unit 1 is always outputted through the output connector 11. That is to say, according to the embodiment shown in FIG. 6, it is possible to provide a model without a microphone switch.

Therefore, it is possible to provide a microphone as a model having a switch which allows on/off control of the sound signal output or as a switchless model in which the sound signal is always outputted depending on whether the connector cover 21 provided with the magnet 22 is retrofitted outside the above-mentioned connector receptacle 6*c*.

Further, this allows an end user to easily choose either of the above-mentioned two models according to the use of the microphone, and it is possible to obtain operational effects as described above in the column of the effects of the invention.

Figure 7:
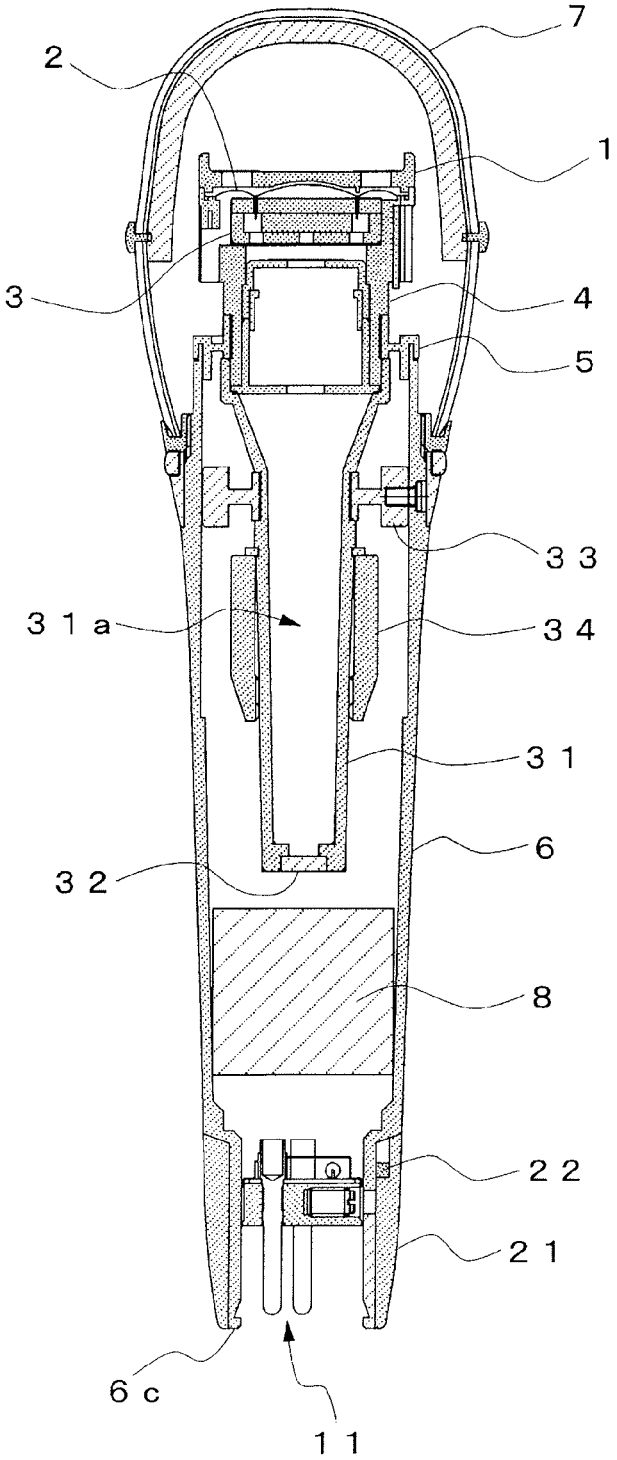
FIG. 7 is an axial sectional view showing the whole structure of the microphone of the second embodiment in accordance with the present invention.
Figure 8C:
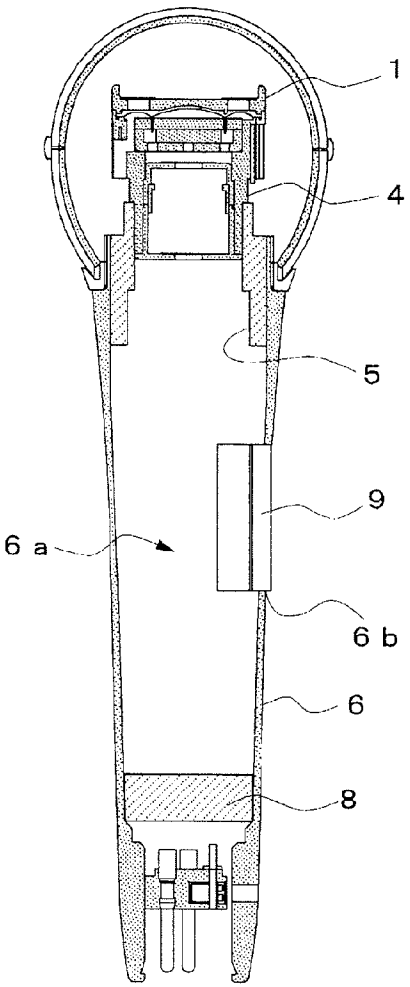
Fig. 8C Prior Art
FIG. 8C is an axial sectional view showing the whole structure of a second example of a conventional microphone with the switch.
Figure 8B:
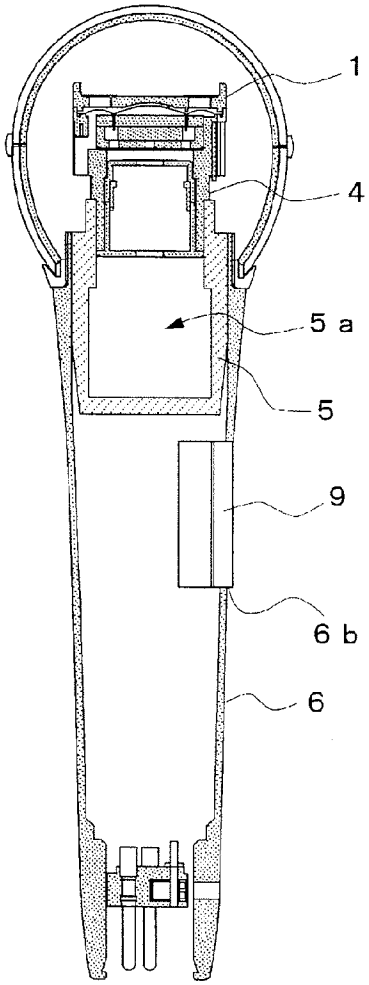
Fig. 8B Prior Art
FIG. 8B is an axial sectional view showing the whole structure of a first example of a conventional microphone with the switch.
Figure 8A:
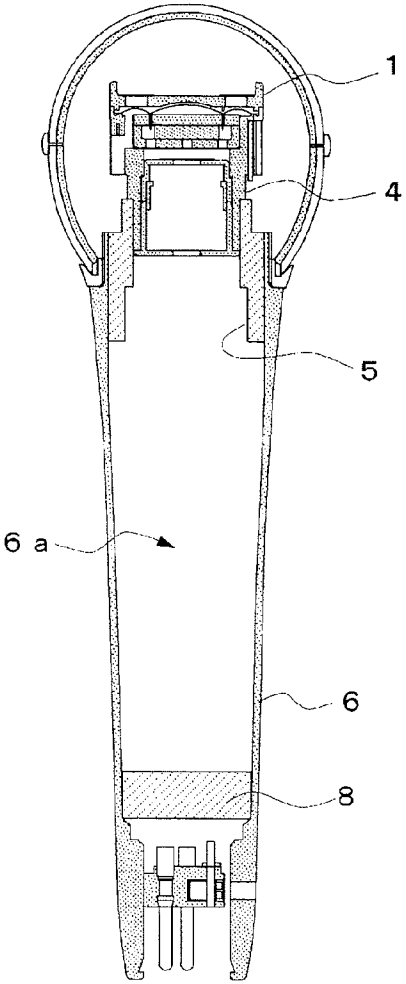
Fig. 8A Prior Art
FIG. 8A is an axial sectional view showing the whole structure of an example of a conventional microphone without a switch.

Next, FIG. 7 shows an example in which the microphone in accordance with the present invention is applied to a dynamic microphone which employs a cancellation system for reducing vibration noises.

It should be noted that, in FIG. 7, like parts achieving the same function as the already described parts are referred to by like numerals, and the description of each part will not be repeated.

In the dynamic microphone which employs this cancellation system, it is necessary to arrange a relatively bulky hollow member for providing an air room on the back side of the microphone unit as will be described below. For this reason, it is difficult to arrange the output switch for the sound signal from the microphone unit at the side wall of the microphone case.

Therefore, also in this type of microphone, it is possible to suitably employ a structure in which the output switch for the sound signal is disposed at the output connector portion at a case end portion.

As shown in FIG. 7, the microphone unit 1 is fitted in and attached to the holder 4, and the hollow member 31 which forms a back air room 31*a* of the microphone unit 1 is connected to the holder 4.

That is to say, the back air room 31*a* surrounded by the above-mentioned hollow member 31 is arranged to be communicated with the back of the diaphragm 2 of the above-mentioned microphone unit 1, an opening 32 is formed at a tail end of the above-mentioned hollow member 31, and an air resistor (indicated by the same reference numeral as the opening 32) is attached to this opening.

Further, the above-mentioned microphone unit 1, the above-mentioned hollow member 31, etc. are arranged in the microphone case 6 respectively through the first and second shock mount members 5 and 33 made of elastic materials, such as rubber.

According to the dynamic microphone which employs the cancellation system as shown in FIG. 7, when gravity is applied in the axial direction of the microphone in response to vibration, a vibration system including the diaphragm and the voice coil will be stopped by friction force and the above-mentioned voice coil will try to move relatively to the magnetic circuit. At this time, a pressure change produced in the back air room 31*a* by the above-mentioned hollow member 31 acts on the back of the diaphragm. As a result, cancellation action occurs which prevents the above-mentioned vibration system from moving relatively to the magnetic circuit. Thus, it is possible to effectively reduce the generation of the vibration noises including a touch noise etc.

In addition, in the structure of the microphone shown in FIG. 7, a weight 34 formed in the shape of a cylinder is attached to the outer periphery of the above-mentioned hollow member 31. Further, the overall centroid of this weight 34, the above-mentioned microphone unit 1, and the above-mentioned hollow member 31 etc. is arranged according to a fulcrum of one shock mount member 33 formed of the elastic material.

With this structure, the microphone unit 1 is unlikely to roll in the microphone case 6 and acts to reduce the vibration noises generated by the rolling of the microphone unit 1.

Also in the structure of the microphone shown in FIG. 7, it is possible to provide the microphone as a model having an output switch for the sound signal similar to those in the example shown in FIG. 4 or 5 above.

Further, by removing the connector cover 21 provided with the magnet 22 from the above-mentioned connector receptacle 6*c*, it is possible to provide a switchless model with which a sound signal is always outputted and obtain similar operational effects.

In addition, in the preferred embodiment as described above, although the structure is illustrated that uses the reed switch as the switch means which is turned on or off in response to the external magnetic field of the magnet, the present invention is not limited to the above-mentioned particular structures. But, a switch means can be employed in which a Hall element that generates electromotive force in response to the external magnetic field and an active element (switching element), such as a transistor etc., are combined.

What is claimed is:

1. A microphone comprising:

a microphone case;

a microphone unit accommodated in the microphone case, and including a magnetic circuit, a diaphragm, and a voice coil attached to the diaphragm and vibratably disposed in a magnetic gap of the magnetic circuit;

an output connector disposed at a rear portion of the microphone case, and including a sound signal output switch to turn on/off a sound signal from said microphone unit; and a connector cover including a magnet therein, and surrounding the output connector;

wherein the sound signal output switch is turned on or off in response to an external magnetic field of the magnet approaching or moving away from the sound signal output switch in connection with a movement of the connector cover relative to the output connector, such that the sound signal output switch on/off controls the sound signal from said microphone unit;

the connector cover is removably attached to said microphone case;

when the connector cover is removed from the microphone case, the microphone maintains a state wherein the sound signal output switch turns on; and when the connector cover is mounted on the microphone case, the sound signal is on or off controlled by the sound signal output switch.

2. A microphone as claimed in claim 1, wherein the microphone case includes a cylindrical connector receptacle at a rear portion thereof, and said connector cover circumferentially covers said connector receptacle and is formed in a shape of a cylinder; and said connector cover relatively moves in an axial direction with respect to said connector receptacle such that said magnet approaches or moves away from said sound signal output switch to on/off control the sound signal from said microphone unit.

3. A microphone as claimed in claim 1, wherein the microphone case includes a cylindrical connector receptacle at a rear portion thereof, and said connector cover circumferentially covers said connector receptacle and is formed in a shape of a cylinder; and said connector cover rotates around an axis with respect to said connector receptacle such that said magnet approaches or moves away from said sound signal output switch to on/off control the sound signal from said microphone unit.

4. A microphone as claimed in claim 1, wherein said sound signal output switch which is turned on or off in response to the external magnetic field comprises a reed switch or a Hall element so that the sound signal output switch turns on or off without physically applying a force to the sound signal output switch.

5. A microphone as claimed in claim 1, wherein a back of the diaphragm is opened in said microphone case.

6. A microphone as claimed in claim 4, wherein a back of the diaphragm is opened in said microphone case.

7. A microphone as claimed in claim 1, further comprising a hollow member connected to the microphone unit, wherein a back of the diaphragm is communicated with an inside of the hollow member which forms a back air room, and said hollow member is accommodated in said microphone case.

8. A microphone as claimed in claim 4, further comprising a hollow member connected to the microphone unite, wherein a back of the diaphragm is communicated with an inside of the hollow member which forms a back air room, and said hollow member is accommodated in said microphone case.

9. A microphone as claimed in claim 1, wherein the sound signal output switch is a reed switch, the output connector includes a connector base, pins press-fitted in the connector base, a circuit board attached to the connector base and having circuit patterns connected to the pins, and the reed switch connecting between the circuit patterns, and when the magnet of the connector cover approaches the read switch, a contact of the reed switch facing the magnet is excited to become an ON state, and the sound signal from the microphone unit becomes a short circuit state such that an output from the output connector is blocked; and when the magnet of the connector cover moves away from the reed switch, the reed switch becomes an OFF state, and the sound signal from the microphone unit is outputted through the output connector.

10. A microphone as claimed in claim 9, wherein the connector cover includes a groove portion circumferentially extending around an inner circumference thereof, and the magnet is disposed on the groove portion.

11. A microphone as claimed in claim 7, further comprising a seal member behind the hollow member to define the back air room.

* * * * *